US011828475B2

(12) United States Patent
Ma et al.

(10) Patent No.: US 11,828,475 B2
(45) Date of Patent: Nov. 28, 2023

(54) HEATING WATER HEATER AND CONTROL METHOD THEREOF, AND COMPUTER-READABLE STORAGE MEDIUM

(71) Applicants: WUHU MIDEA KITCHEN AND BATH APPLIANCES MFG. CO., LTD., Wuhu (CN); MIDEA GROUP CO., LTD., Foshan (CN)

(72) Inventors: Zhihao Ma, Wuhu (CN); Guorong Liang, Wuhu (CN); Shuangyue Ni, Wuhu (CN); Yongming Zhang, Wuhu (CN); Daoyuan Kang, Wuhu (CN); Chaohui Huang, Wuhu (CN)

( * ) Notice: Subject to any disclaimer, the term of this patent is extended or adjusted under 35 U.S.C. 154(b) by 0 days.

(21) Appl. No.: 17/764,543

(22) PCT Filed: Jun. 1, 2020

(86) PCT No.: PCT/CN2020/093769
§ 371 (c)(1),
(2) Date: Mar. 29, 2022

(87) PCT Pub. No.: WO2021/063010
PCT Pub. Date: Apr. 8, 2021

(65) Prior Publication Data

US 2022/0341599 A1 Oct. 27, 2022

(30) Foreign Application Priority Data

Sep. 30, 2019 (CN) ..... 201910952541.7
Sep. 30, 2019 (CN) ..... 201921674737.6

(51) Int. Cl.
*F24H 1/52* (2022.01)
*F24D 19/10* (2006.01)
*F24H 9/20* (2022.01)

(52) U.S. Cl.
CPC ..... *F24D 19/1069* (2013.01); *F24D 19/1051* (2013.01); *F24H 9/2007* (2013.01)

(58) Field of Classification Search
CPC ..... F24H 1/12; F24H 1/52; F24H 9/20; F24H 9/2007; F24D 19/1069; F24D 19/1051
See application file for complete search history.

(56) References Cited

U.S. PATENT DOCUMENTS

2018/0314275 A1 11/2018 Aoki et al.
2019/0154303 A1 5/2019 Kitano et al.

FOREIGN PATENT DOCUMENTS

CN 103090547 A 5/2013
CN 106288344 A 1/2017
(Continued)

OTHER PUBLICATIONS

Supplementary European Search Report dated Oct. 17, 2022 of Application No. 20873150.5.
(Continued)

*Primary Examiner* — Gregory A Wilson
(74) *Attorney, Agent, or Firm* — KILPATRICK TOWNSEND & STOCKTON, LLP

(57) ABSTRACT

Disclosed are a method for controlling a heating water heater, a heating water heater, and a computer-readable storage medium. The method includes: controlling the heating outlet to be closed and the heat supply outlet to be opened after receiving a bath water signal; obtaining a water temperature of a bath outlet; obtaining a duration that the water temperature at the bath outlet is within a preset water temperature range; controlling an opening degree of the heat supply outlet to decrease and an opening degree of the heating outlet to increase when the duration is greater than or equal to a first preset duration, and a heat load of the heating water heater is less than a rated load; and controlling the heat load of the heating water heater to increase, and
(Continued)

maintaining the water temperature at the bath outlet within the preset water temperature range.

20 Claims, 9 Drawing Sheets

(56) References Cited

FOREIGN PATENT DOCUMENTS

| | | | | | |
|---|---|---|---|---|---|
| CN | 106369653 | A | | 2/2017 | |
| CN | 106500301 | A | | 3/2017 | |
| CN | 108870736 | A | * | 11/2018 | ..... F24D 15/02 |
| CN | 108870736 | A | | 11/2018 | |
| CN | 108870759 | A | | 11/2018 | |
| CN | 109357302 | A | | 2/2019 | |
| CN | 109489241 | A | | 3/2019 | |
| CN | 109506373 | A | | 3/2019 | |
| CN | 110044066 | A | * | 7/2019 | ..... F24H 1/52 |
| CN | 114941907 | A | * | 8/2022 | |
| EP | 1847781 | A2 | | 10/2007 | |
| EP | 1847781 | B1 | * | 3/2017 | ..... F24D 10/006 |
| JP | H06117646 | A | | 4/1994 | |
| KR | 101586165 | B1 | | 1/2016 | |

OTHER PUBLICATIONS

First OA dated May 7, 2022 of CN App No. 201910952541.7.
International Search Report of PCT Application No. PCT/CN2020/093769.

* cited by examiner

HEATING WATER HEATER AND CONTROL METHOD THEREOF, AND COMPUTER-READABLE STORAGE MEDIUM

CROSS-REFERENCES TO RELATED APPLICATIONS

The present disclosure is a national phase application of International Application No. PCT/CN2020/093769, filed on Jun. 1, 2020, which claims priority to Chinese Patent Application No. 201910952541.7 and Chinese Patent Application No. 201921674737.6, both filed on Sep. 30, 2020, the entireties of which are herein incorporated by reference.

FIELD

The present disclosure relates to the technical field of water heaters, and in particular, to a method for controlling a heating water heater, a heating water heater, and a computer-readable storage medium.

BACKGROUND

A heating water heater is a thermal device that can provide heating hot water and domestic hot water. When the currently widely used heating water heaters are in heating mode, and the user needs to use domestic hot water, the heating water heaters will stop heating and only produce domestic hot water. If the user uses domestic hot water for a long time, the heating water heater will not provide indoor heating for a long time, which will cause the indoor temperature to drop, to affect the user experience.

SUMMARY

The main objective of the present disclosure is to provide a method for controlling a heating water heater, which aims to provide domestic hot water while reducing the drop of indoor temperature.

Embodiments of the present disclosure provide a heating water heater, including: a flow distributor, a heating branch, a heat supply branch and a bath flow path, the flow distributor has a heating outlet connected to the heating branch and a heat supply outlet connected to the heat supply branch, and the bath flow path is configured for heat exchange with the heat supply branch;

The method for controlling the heating water heater includes the following operations:

controlling the heating outlet to be closed and the heat supply outlet to be opened after receiving a bath water signal;

obtaining a water temperature of a bath outlet;

obtaining a duration that the water temperature at the bath outlet is within a preset water temperature range;

controlling an opening degree of the heat supply outlet to decrease and an opening degree of the heating outlet to increase when the duration is greater than or equal to a first preset duration, and a heat load of the heating water heater is less than a rated load; and controlling the heat load of the heating water heater to increase, and maintaining the water temperature at the bath outlet within the preset water temperature range.

In an embodiment, the operation of controlling an opening degree of the heat supply outlet to decrease and an opening degree of the heating outlet to increase when the duration is greater than or equal to a first preset duration, and a heat load of the heating water heater is less than a rated load includes:

controlling the flow distributor to adjust successively towards the heating outlet, and the opening degree of the heat supply outlet decreases successively and the opening degree of the heating outlet increases successively when the duration is greater than or equal to the first preset duration, and the heat load of the heating water heater is less than the rated load;

the operation of controlling the heat load of the heating water heater to increase, and maintaining the water temperature at the bath outlet within the preset water temperature range includes:

each time the flow distributor is adjusted towards the heating outlet, controlling the heat load of the heating water heater to increase once, and maintaining the water temperature at the bath outlet within the preset water temperature range; and stopping to adjust the flow distributor when the heat load of the heating water heater reaches the rated load.

In an embodiment, the heating water heater further includes a motor connected to the flow distributor;

the motor is a synchronous motor, and each time the flow distributor is adjusted towards the heating outlet, a corresponding power-on duration of the synchronous motor is t/n; t is a power-on duration required for the synchronous motor to drive the flow distributor to completely switch between the heating outlet and the heat supply outlet, and n is a constant; or the motor is a stepping motor, and each time the flow distributor is adjusted towards the heating outlet, a corresponding number of pulses sent to the stepping motor is N/n; N is a number of pulses required for the stepping motor to drive the flow distributor to completely switch between the heating outlet and the heat supply outlet, and n is a constant.

In an embodiment, after the operation of stopping to adjust the flow distributor when the heat load of the heating water heater reaches the rated load, the method further includes:

controlling the heat supply outlet to increase a preset opening degree, and the heating outlet to decrease the preset opening degree when the water temperature at the bath outlet is lower than the preset water temperature range, and adjusting the heat load of the heating water heater and maintaining the water temperature at the bath outlet within the preset water temperature range.

In an embodiment, the operation of controlling the heat supply outlet to increase a preset opening degree, and the heating outlet to decrease the preset opening degree when the water temperature at the bath outlet is lower than the preset water temperature range includes:

obtaining adjustment times A of the flow distributor towards the heating outlet;

obtaining flow $q_1$ of the bath flow path when the water temperature of the bath outlet is within the preset water temperature range;

obtaining flow $q_2$ of the bath flow path when the water temperature at the bath outlet is lower than the preset water temperature range;

calculating the preset opening degree according to A, $q_1$ and $q_2$; and controlling the heat supply outlet to increase the preset opening degree, and the heating outlet to decrease the preset opening degree.

In an embodiment, the heating water heater further includes a motor connected to the flow distributor;

the motor is a synchronous motor, and a power-on duration of the synchronous motor corresponding to the preset opening degree is Bt/n; or the motor is a stepping motor, and a number of pulses sent to the stepping motor corresponding to the preset opening degree is BN/n; and B is calculated from A, $q_1$, and $q_2$, and n is a constant.

In an embodiment, a relationship between B and A, $q_1$ and $q_2$ is: $B=(q_2-q_1)(n-A)/q_1$.

In an embodiment, n is greater than or equal to 10 and less than or equal to 20.

In an embodiment, the method for controlling the heating water heater further includes the following operations:

obtaining an instruction to stop heating;

controlling the heating outlet to be closed, and the heat supply outlet to be fully opened when both the heating outlet and the heat supply outlet are open; and adjusting the heat load of the heating water heater and maintaining the water temperature at the bath outlet within the preset water temperature range.

In an embodiment, the operation of controlling the heating outlet to be closed, and the heat supply outlet to be fully opened when both the heating outlet and the heat supply outlet are open includes:

controlling the flow distributor to adjust successively towards the heat supply outlet when both the heating outlet and the heat supply outlet are open, and the opening degree of the heat supply outlet increases and the opening of the heating outlet decreases successively;

the operation of adjusting the heat load of the heating water heater and maintaining the water temperature at the bath outlet within the preset water temperature range includes:

each time the flow distributor is adjusted towards the heating outlet, controlling the heat load of the heating water heater to decrease once, and maintaining the water temperature at the bath outlet within the preset water temperature range; and stopping to adjust the flow distributor when the heating outlet is closed and the heat supply outlet is fully opened.

The present disclosure further provides a heating water heater, and the heating water heater includes a first heat exchanger, a heating branch, a heat supply branch, a bath flow path and a flow distributor, the bath flow path is configured for exchanging heat with the heat supply branch, the flow distributor has a heating outlet connected to the heating branch, a heat supply outlet connected to the heat supply branch, and a water inlet connected to the first heat exchanger;

the heating water heater further includes a memory, a processor, and a computer program stored in the memory and executable on the processor, when the computer program is executed by the processor, the operations of the method as described above are implemented.

In an embodiment, the flow distributor also has a hot water inlet, a heating diversion port, a hot water diversion port, a bath inlet and a bath outlet, the flow distributor includes a first valve core and a second valve core, the first valve core is provided between the hot water inlet, the heating diversion port and the hot water diversion port, and the second valve core is provided between the bath inlet and the bath outlet.

In an embodiment, the heating water heater further includes:

a heating system including a heating water outlet, a heating water return outlet, and a first heat exchanger between the heating water outlet and the heating water return outlet, the heating water outlet being connected to the heating diversion port, the first heat exchanger being connected to the hot water inlet; and a hot water system including a heating flow path and a bath flow path, the heating flow paths being respectively connected to the first heat exchanger and the hot water diversion port, the bath flow path being configured for exchanging heat with the heating flow path, the bath flow path including a first inlet connected to the bath inlet and a first outlet connected to the bath outlet.

In an embodiment, an opening direction of the bath outlet is lateral, and the bath inlet and the bath outlet are jointly provided on a same side of the hot water inlet, the heating diversion port and the hot water diversion port.

In an embodiment, the hot water inlet, the heating diversion port, the hot water diversion port and the bath outlet are respectively provided on different surfaces of the flow distributor, and the hot water diversion port and the bath inlet are provided on a same side of the flow distributor.

In an embodiment, the flow distributor also has a spare water outlet in communication with the bath inlet and the bath outlet, and the flow distributor further includes a blocking member for blocking the spare water outlet.

In an embodiment, the flow distributor has a heating-only working state, a warming-only working state and a heating and warming mixed working state;

the first valve core is configured to communicate the hot water inlet with the heating diversion port under the heating-only working state;

the first valve core is configured to communicate the hot water inlet with the hot water diversion port under the warming-only working state; and the first valve core is configured to communicate both the heating diversion port and the hot water diversion port with the hot water inlet under the heating and warming mixed working state.

In an embodiment, the flow distributor is provided with a heating diversion flow channel, a warming diversion flow channel and a heating outlet flow channel, the heating diversion flow channel and the warming diversion flow channel are respectively connected to the hot water inlet, and the hot water diversion port is provided on a pipe wall of the warming diversion flow channel;

a pipe wall of the heating diversion flow channel is provided with a first opening passing through the flow distributor, the heating outlet flow channel is extended to pass through one of the surfaces of the flow distributor to form the heating diversion port, a pipe wall of the heating outlet flow channel is provided with a second opening passing through the flow distributor, the first opening and the second opening are connected by a bypass pipeline.

In an embodiment, the heating water heater further includes a housing, and the first heat exchanger and the flow distributor are provided in the housing, and the flow distributor is fixed to a bottom wall of the housing.

The present disclosure further provides a computer-readable storage medium, and a processing program for a heating water heater is stored in the computer-readable storage medium, when the processing program for the heating water heater is executed by a controller, the operations of the method for controlling the heating water heater as described above are implemented.

In the present disclosure, when the heating water heater switches from the heating-only state (that is, the state in which all the hot water produced by the heating water heater flows from the heating outlet and is used for indoor heating) to the heating-only bath water state (the state in which all the hot water produced by the heating water heater flows from the heat supply outlet and is used to heat the bath water), only after the water temperature at the bath outlet is maintained within the preset water temperature range for a period of time to ensure that the water temperature at the bath outlet is relatively stable, the flow distributor is controlled to switch, and the opening degree of the heating outlet is increased, and the opening of the bath outlet is correspondingly reduced. While adjusting the flow distributor, even if the opening degree of the bath outlet is adjusted and a part of the hot water used to heat the bath water is diverted to heat the room, it is also possible to maintain the water temperature at the bath outlet within the preset water temperature range by increasing the load of the heating water heater, to avoid excessive fluctuation of the water temperature at the bath outlet, and to ensure the continuous comfort when the user uses water. In addition, after receiving the bath water signal, the system is not always in the state of heating-only bath water, but after the water temperature at the bath outlet is maintained within the preset water temperature range for a period of time, the system will enter the state of simultaneous warming and heating. During this process, the room temperature does not drop significantly, and it can generally be maintained within a more comfortable range, so the impact on the user is almost negligible.

BRIEF DESCRIPTION OF THE DRAWINGS

The embodiments of the present disclosure will be described by the following which briefly introduces the accompanying drawings. The drawings in the following description are only some embodiments of the present disclosure. Other drawings can also be obtained based on the structures shown in these drawings.

DESCRIPTION OF REFERENCE SIGNS

Figure 1:
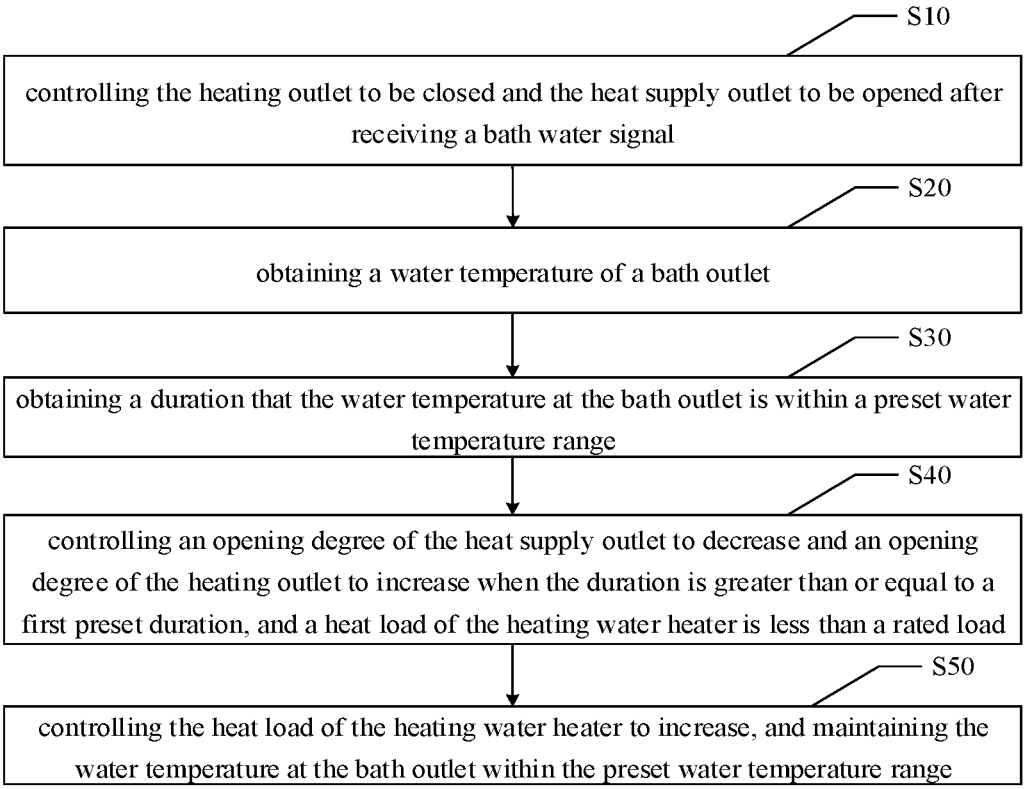
FIG. 1 is a schematic flowchart of a method for controlling a heating water heater according to an embodiment of the present disclosure.

| Reference sign | Name |
|---|---|
| 10 | first heat exchanger |
| 20 | heating branch |
| 30 | heat supply branch |
| 40 | bath flow path |
| 104 | bath inlet |
| 105 | bath outlet |
| 43 | flow sensor |
| 101 | hot water inlet |
| 102 | heating diversion port |
| 103 | hot water diversion port |
| 106 | spare water outlet |
| 11 | first valve core |
| 12 | blocking member |
| 13 | heating diversion flow channel |
| 131 | first opening |
| 14 | warming diversion flow channel |
| 15 | heating outlet flow channel |
| 151 | second opening |
| 44 | first temperature sensor |
| 45 | second temperature sensor |
| 50 | flow distributor |
| 60 | third temperature sensor |
| 70 | water pump |
| 80 | second heat exchanger |
| 21 | heating water outlet |
| 22 | heating water return outlet |
| 41 | first inlet |
| 42 | first outlet |
| 43 | bath water circulating pump |
| 46 | water storage tank |
| 47 | first bath water pipeline |
| 48 | second bath water pipeline |
| 49 | third bath water pipeline |
| 90 | housing |
| 16 | bypass pipeline |

The realization of the objective, functional characteristics, and advantages of the present disclosure are further described with reference to the accompanying drawings.

DETAILED DESCRIPTION OF THE DISCLOSURE

The technical solutions of the embodiments of the present disclosure will be described in more detail below with reference to the accompanying drawings. It is obvious that the embodiments to be described are only some rather than all of the embodiments of the present disclosure.

It should be noted that if there is a directional indication (such as up, down, left, right, front, rear . . . ) in the embodiments of the present disclosure, the directional indication is only used to explain the relative positional relationship, movement, etc. of the components in a posture (as shown in the drawings). If the specific posture changes, the directional indication will change accordingly.

It should be noted that, the descriptions associated with, e.g., "first" and "second," in the present disclosure are merely for descriptive purposes, and cannot be understood as indicating or suggesting relative importance or impliedly indicating the number of the indicated feature. Therefore, the feature associated with "first" or "second" can expressly or impliedly include at least one such feature. Besides, the meaning of "and/or" appearing in the disclosure includes three parallel scenarios. For example, "A and/or B" includes only A, or only B, or both A and B. In addition, the various embodiments can be combined with each other. When the combination of the embodiments is contradictory or cannot be achieved, it should be considered that such a combination of the embodiments does not exist, nor is it within the scope of the present disclosure.

The present disclosure provides a method for controlling a heating water heater.

In some embodiments of the present disclosure, the heating water heater includes a flow distributor, a heating branch, a heat supply branch and a bath flow path, the flow distributor has a heating outlet connected to the heating branch and a heat supply outlet connected to the heat supply branch, and the bath flow path is configured for heat exchange with the heat supply branch.

As shown in FIG. 1, the method for controlling the heating water heater includes the following operations:

Operation S10, controlling the heating outlet to be closed and the heat supply outlet to be opened after receiving a bath water signal.

In the operation S10, the bath water signal refers to the signal indicating that there is water flowing in the bath flow path, that is, the user starts to use hot water for bathing, washing hands, washing dishes or other cleaning, or the like. For example, in some scenarios, the bath flow path is opened, and water can flow in the bath flow path, which is regarded as receiving the bath water signal. In some scenarios, the heating water heater has the function of reserving bath water. When the reservation time is reached, the heating water heater automatically heats the bath water, and the water begins to flow in the bath flow path, at this time, it is regarded as receiving the bath water signal, and the heated water can flow into the water storage tank for storage, and the hot water can be produced immediately when the user needs.

In this operation, when the bath water signal is received, it indicates that the user needs to use hot water for bathing. Therefore, in order to obtain hot water quickly, the heating outlet is controlled to be closed and the heat supply outlet is opened. Since the hot water is no longer diverted to the heating branch for indoor heating, all the hot water flows into the heating branch for heat exchange with the bath water, and the bath water can be quickly heated.

It is conceivable that controlling the heating outlet to be closed and the heat supply outlet to be opened is essentially controlling the flow distributor to adjust.

Operation S20, obtaining a water temperature of a bath outlet.

The bath flow path has a bath inlet and a bath outlet. The bath inlet is in communication with a water source such as tap water, and the bath outlet is in communication with a shower, a faucet or a water storage tank, or the like. The water at the bath outlet has achieved heat exchange with the heat supply branch. By detecting the water temperature at the bath outlet, the actual water temperature and the heat exchange between the bath flow path and the heat supply branch can be obtained.

Operation S30, obtaining a duration that the water temperature at the bath outlet is within a preset water temperature range.

The flow distributor closes the heating outlet. After the heat supply outlet is opened, all the hot water is used to make hot water for bath use. However, the temperature of the hot water flowing from the bath outlet may not meet the user's needs, so it is necessary to adjust the water temperature at the user's water end at this time. The user's needs can be met by adjusting the water temperature at the bath outlet to within a preset water temperature range. The adjustment methods include but are not limited to the following: adjusting the heat load of the heating water heater, for example, when the heating water heater is a gas furnace, adjusting the gas intake volume of the burner; when the heating water heater is an electric water heater, adjusting the electric power of the heating module. The flow of the bath flow path is adjusted, and the flow of the bath flow path is increased or decreased, and the water temperature at the bath outlet is maintained within the preset water temperature range. A water mixing valve is provided at the bath outlet, and the normal temperature water pipe branch is connected to the water mixing valve, and the water temperature at the bath outlet is adjusted by mixing with normal temperature water.

The preset water temperature range in this operation is the temperature value pre-stored by the controller, and usually a value temporarily set by the user or a different value set in advance by the manufacturer according to different water consumption modes. Within this range, the user can ignore or accept temperature changes. In some examples, the preset water temperature range refers to a larger range, for example, when washing dishes or cleaning tables and floors, the requirements for water temperature are lower, the preset water temperature range refers to ±5° C. or ±10° C. of the preset value, or the like. In some examples, the preset water temperature range refers to a smaller range. For example, when taking a bath or using water for infants and young children, such users are more sensitive to the water temperature, and the preset water temperature range refers to ±2° C. of the preset value, that is, to ensure that the current water temperature at the bath outlet fluctuates between the preset value plus 2° C. and the preset value minus 2° C.

Operation S40, controlling an opening degree of the heat supply outlet to decrease and an opening degree of the heating outlet to increase when the duration is greater than or equal to a first preset duration, and a heat load of the heating water heater is less than a rated load.

Due to the influence of the heat load of the heating water heater, the heat exchange efficiency, the flow rate in the bath flow path, the flow rate of the heat supply branch and other factors, the water temperature at the bath outlet is not always maintained at a value. When the water temperature at the bath outlet remains within the preset water temperature range for a long time, it indicates that the heat exchange is relatively stable at this time. In order to prevent the indoor temperature from falling continuously, it is necessary to control the flow distributor to distribute part of the hot water for indoor heating at this time. That is, when the duration is greater than or equal to the first preset duration, and the heat load of the heating water heater is less than the rated load, it is necessary to control the opening degree of the heat supply outlet to decrease and the opening degree of the heating outlet to increase to ensure that both the heat supply outlet and the heating outlet are partially opened.

Operation S50, controlling the heat load of the heating water heater to increase, and maintaining the water temperature at the bath outlet within the preset water temperature range.

Since both the heat supply outlet and the heating outlet are partially opened, the heated hot water is used for both indoor heating and bath water heating. In order to avoid insufficient heat for heating the bath water due to the diversion of hot water, the heat load of the heating water heater is controlled to increase, and the water temperature at the bath outlet is maintained within the preset water temperature range.

In the present disclosure, when the heating water heater switches from the heating-only state (that is, the state in which all the hot water produced by the heating water heater flows from the heating outlet and is used for indoor heating) to the heating-only bath water state (the state in which all the hot water produced by the heating water heater flows from the heat supply outlet and is used to heat the bath water), only after the water temperature at the bath outlet is maintained within the preset water temperature range for a period of time to ensure that the water temperature at the bath outlet is relatively stable, the flow distributor is controlled to switch, and the opening degree of the heating outlet is increased, and the opening of the bath outlet is correspondingly reduced. While adjusting the flow distributor, even if the opening degree of the bath outlet is adjusted and a part of the hot water used to heat the bath water is diverted to heat the room, it is also possible to maintain the water temperature at the bath outlet within the preset water temperature range by increasing the load of the heating water heater, to avoid excessive fluctuation of the water temperature at the bath outlet, and to ensure the continuous comfort when the user uses water.

Figure 2:
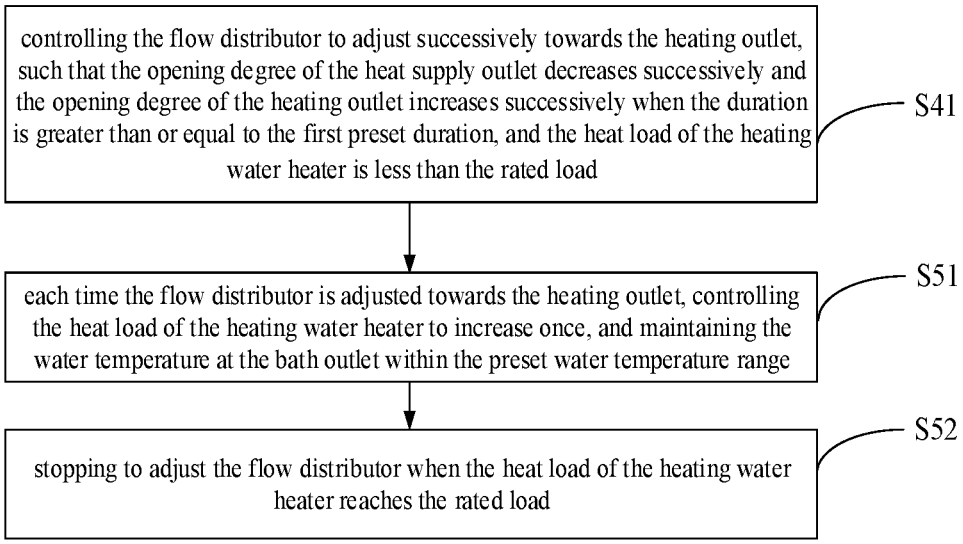
FIG. 2 is a detailed schematic flowchart of operation S40 and operation S50 in FIG. 1.

As shown in FIG. 2, the operation S40 includes the following operations:

Operation S41, controlling the flow distributor to adjust successively towards the heating outlet, and the opening degree of the heat supply outlet decreases successively and the opening degree of the heating outlet increases successively when the duration is greater than or equal to the first preset duration, and the heat load of the heating water heater is less than the rated load.

If the flow distributor adjusts the heating outlet and the heat supply outlet in place at one time, the opening degree of the heating outlet increases a lot instantly, while the opening degree of the heat supply outlet decreases a lot instantly, and the hot water flow in the heat supply branch suddenly decreases a lot. As a result, the water temperature at the bath outlet is easily lower than the preset water temperature range, and the water temperature felt by the user is instantly reduced a lot. Therefore, in order to avoid this phenomenon, in operation S41, the flow distributor is adjusted successively, and in each adjustment, the opening degree of the heat supply outlet is reduced less, so the fluctuation of the water temperature at the bath outlet can be alleviated.

In an embodiment, the first preset duration is greater than or equal to 0.5 minutes and less than or equal to 3 minutes. For example, the first preset time period may be 0.5 min, 1 min, or 3 min, and so on.

The operation S50 includes:

Operation S51, each time the flow distributor is adjusted towards the heating outlet, controlling the heat load of the heating water heater to increase once, and maintaining the water temperature at the bath outlet within the preset water temperature range.

Each time the flow distributor is adjusted towards the heating outlet, the opening degree of the heat supply outlet will inevitably decrease once, each time the hot water flowing into the heat supply outlet decreases and the hot water used for heat exchange with the bath water decreases, the water temperature at the bath outlet will inevitably drop. Therefore, each time the flow distributor is adjusted, the heat load of the heating water heater is controlled to increase once. The heat load of the heating water heater is adjusted to maintain the water temperature at the outlet of the bath within the preset water temperature range to ensure the comfort when the user uses the water.

In the present disclosure, since the flow distributor is adjusted successively towards the heating outlet, and the opening degree of the heat supply outlet closed each time is small, the reduction of the hot water flowing into the heat supply branch for heating the bath water is smaller each time. Therefore, the reduction degree of the water temperature at the bath outlet is relatively low, and it can still be maintained within the preset water temperature range after the reduction. The water temperature can be maintained within the preset water temperature range at least in a short period of time after adjusting the flow distributor to meet the user's demand for using water. Each time the flow distributor is adjusted, the heat load of the heating water heater is adjusted once, and the water temperature at the bath outlet rises and is stabilized within the preset water temperature range, thus the water temperature at the bath outlet can be prevented from falling out of the preset water temperature range, and the continuous comfort when the user uses water can be ensured.

Operation S52, stopping to adjust the flow distributor when the heat load of the heating water heater reaches the rated load.

During the process of repeatedly adjusting the heat load of the heating water heater, when the heat load of the heating water heater reaches the rated load, the adjustment of the flow distributor is stopped, the heating water heater works at rated load, and the water temperature at the bath outlet is maintained within the preset water temperature range. Indoor heating also has the function of hot water, and the heating water heater simultaneously performs indoor heating and provides bath water.

The heating water heater further includes a motor connected to the flow distributor.

In an embodiment, the motor is a synchronous motor, and each time the flow distributor is adjusted towards the heating outlet, a power-on duration of the corresponding synchronous motor is t/n; t is a power-on duration required for the synchronous motor to drive the flow distributor to completely switch between the heating outlet and the heat supply outlet, and n is a constant.

In an embodiment, the motor is a stepping motor, and each time the flow distributor is adjusted towards the heating outlet, a number of pulses sent to the corresponding stepping motor is N/n; N is a number of pulses required for the stepping motor to drive the flow distributor to completely switch between the heating outlet and the heat supply outlet, and n is a constant.

In an embodiment, n is greater than or equal to 10 and less than or equal to 20. The value of n can be 10, 12, 15, or 20, or the like, and the value of n is different, and the opening degree of the heat supply outlet decreases each time is different.

Figure 3:
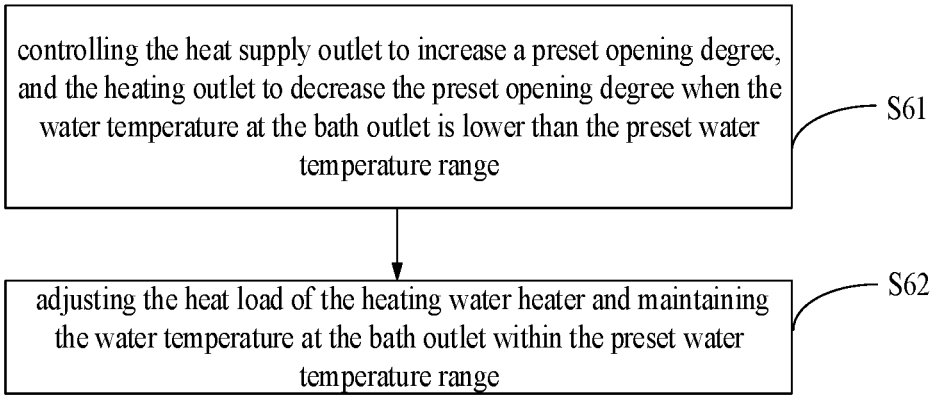
FIG. 3 is another schematic flowchart of the method for controlling the heating water heater in FIG. 1.

As shown in FIG. 3, after the operation S52 of stopping to adjust the flow distributor when the heat load of the heating water heater reaches the rated load, the method further includes:

Operation S61, controlling the heat supply outlet to increase a preset opening degree, and the heating outlet to decrease the preset opening degree when the water temperature at the bath outlet is lower than the preset water temperature range.

Due to the influence of water flow rate, tap water temperature, heat exchange efficiency, working time and other factors, after the heating water heater works for a long time, the water temperature at the bath outlet may fluctuate, that is, it is lower than the preset water temperature range. In this case, both the heating outlet and the heat supply outlet are open, and the heat load of the heating water heater reaches the rated load, so it is impossible to increase the water temperature at the bath outlet by increasing the heat load of the heating water heater. Therefore, the heat supply outlet is controlled to increase the preset opening degree, and the heating outlet is controlled to decrease the preset opening degree, and the hot water flowing through the heat supply branch increases, to improve the heat exchange efficiency with the bath water, increasing the water temperature at the bath outlet, and maintaining the water temperature at the bath outlet within the preset water temperature range again.

Operation S62, adjusting the heat load of the heating water heater and maintaining the water temperature at the bath outlet within the preset water temperature range.

Due to the increase of hot water flowing through the heat supply branch, the heat exchange between the heat supply branch and the bath flow path must change. Therefore, it is necessary to adjust the heat load of the heating water heater to maintain the water temperature at the bath outlet within the preset water temperature range.

Figure 4:
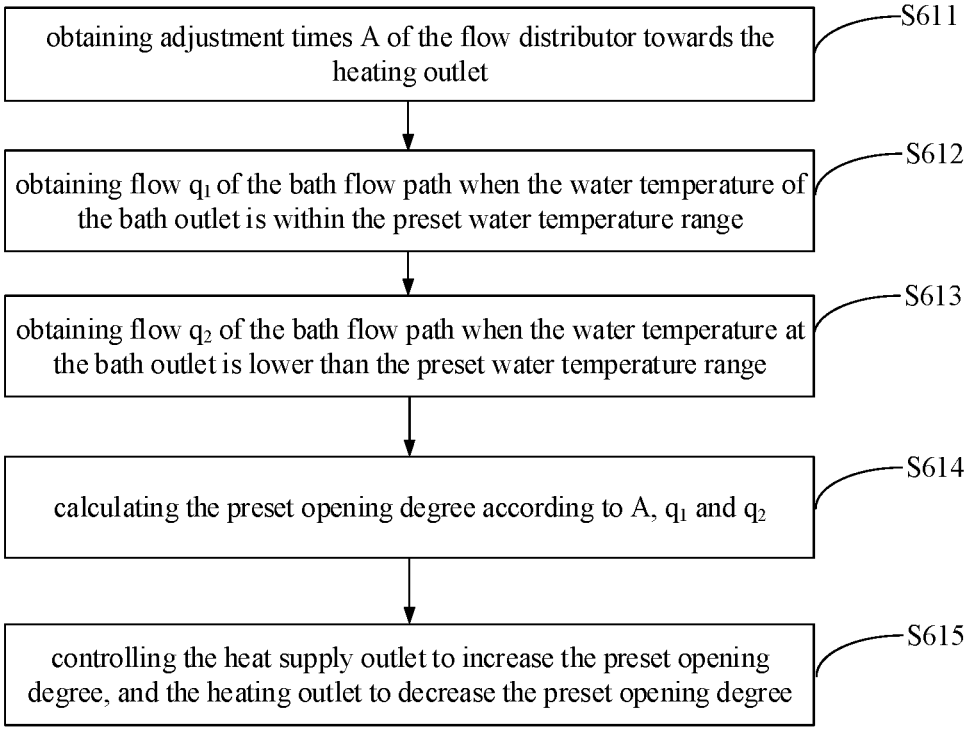
FIG. 4 is a detailed schematic flowchart of operation S61 in FIG. 3.

As shown in FIG. 4, the operation S61 of controlling the heat supply outlet to increase a preset opening degree, and the heating outlet to decrease the preset opening degree when the water temperature at the bath outlet is lower than the preset water temperature range includes the following operations:

Operation S611, obtaining adjustment times A of the flow distributor towards the heating outlet;

Operation S612, obtaining flow $q_1$ of the bath flow path when the water temperature of the bath outlet is within the preset water temperature range;

Operation S613, obtaining flow $q_2$ of the bath flow path when the water temperature at the bath outlet is lower than the preset water temperature range;

Operation S614, calculating the preset opening degree according to A, $q_1$ and $q_2$; and Operation S615, controlling the heat supply outlet to increase the preset opening degree, and the heating outlet to decrease the preset opening degree.

The adjustment times A indicates the initial opening degree of the heat supply outlet before the water temperature at the bath outlet fluctuates greatly. Therefore, when the water temperature at the bath outlet fluctuates greatly, the increased preset opening degree of the heat supply outlet is related to the initial opening degree, and the superposition of the two must be less than or equal to the complete opening degree of the heat supply outlet.

When the flow of the bath flow path suddenly increases, the water temperature at the bath outlet will inevitably change. That is, when it is lower than the preset water temperature range, it is necessary to obtain the flow $q_2$ of the flow path at this time. The flow $q_2$ and the flow $q_1$ indicate that the water temperature at the bath outlet after the change is equivalent to the water temperature at the bath outlet before the change.

It is generally considered that when the water temperature at the bath outlet is lower than 2° C. of the lowest value of the preset water temperature range, the flow of the bath flow path increases. At this time, the opening degree of the heat supply outlet needs to be adjusted to increase the preset opening degree.

In this embodiment, when the water temperature of the bath outlet is lower than the preset water temperature range, and it is necessary to adjust the opening degree of the heat supply outlet, the opening degree is calculated from the adjustment times A of the flow distributor towards the heating outlet, the flow $q_1$ of the bath flow path when the water temperature of the bath outlet is within the preset water temperature range, and the flow $q_2$ of the bath flow path when the water temperature at the bath outlet is lower than the preset water temperature range. That is, the changed preset opening degree is closely related to the current opening degree of the heat supply outlet and the water temperature before and after the change of the bath outlet.

In an embodiment, the motor is a synchronous motor, and a power-on duration of the synchronous motor corresponding to the preset opening degree is Bt/n. That is, when the water temperature of the bath outlet is lower than the preset water temperature range, the power-on duration of the synchronous motor is controlled to be Bt/n, and the heat supply outlet increases the preset opening degree, and the heating outlet decreases the preset opening degree.

In an embodiment, the motor is a stepping motor, and a number of pulses sent to the stepping motor corresponding to the preset opening degree is BN/n. That is, when the water temperature of the bath outlet is lower than the preset water temperature range, the number of pulses sent to the stepping motor is controlled to be BN/n, and the heat supply outlet increases the preset opening degree, and the heating outlet decreases the preset opening degree. B is calculated from A, $q_1$, and $q_2$.

In an embodiment, a relationship between B and A, $q_1$ and $q_2$ is: $B=(q_2-q_1)(n-A)/q_1$. The preset opening degree is proportional to the difference between the two flows before and after. The difference between the two flows before and after indicates the temperature difference between the two before and after. The larger the temperature difference, the greater the drop in the water temperature at the bath outlet, so a larger preset opening degree is required, the opening degree of the heat supply outlet is larger, and more hot water acts on heating the bath water, and the water temperature at the bath outlet rises rapidly.

Figure 5:
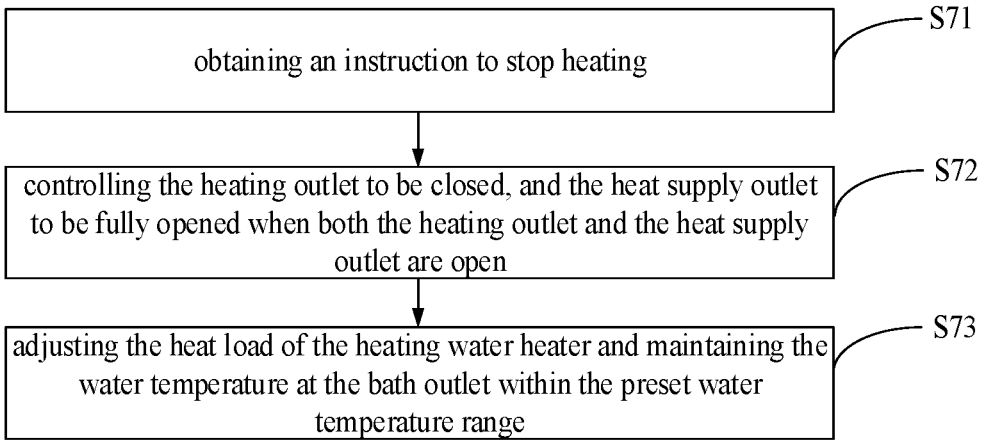
FIG. 5 is still another schematic flowchart of the method for controlling the heating water heater in FIG. 1.

As shown in FIG. 5, the method for controlling the heating water heater further includes the following operations:

Operation S71, obtaining an instruction to stop heating;

Operation S72, controlling the heating outlet to be closed, and the heat supply outlet to be fully opened when both the heating outlet and the heat supply outlet are open; and Operation S73, adjusting the heat load of the heating water heater and maintaining the water temperature at the bath outlet within the preset water temperature range.

In this embodiment, when the heating water heater is in the state of heating and heating bath water at the same time, the instruction to stop heating is issued due to the high indoor temperature, the heating outlet is controlled to be closed and the heat supply outlet is fully opened, and all the hot water is used to heat the bath water in the bath flow path, and at the same time, the heat load of the heating water heater is adjusted, and the water temperature at the bath outlet is maintained within the preset water temperature range.

Figure 6:
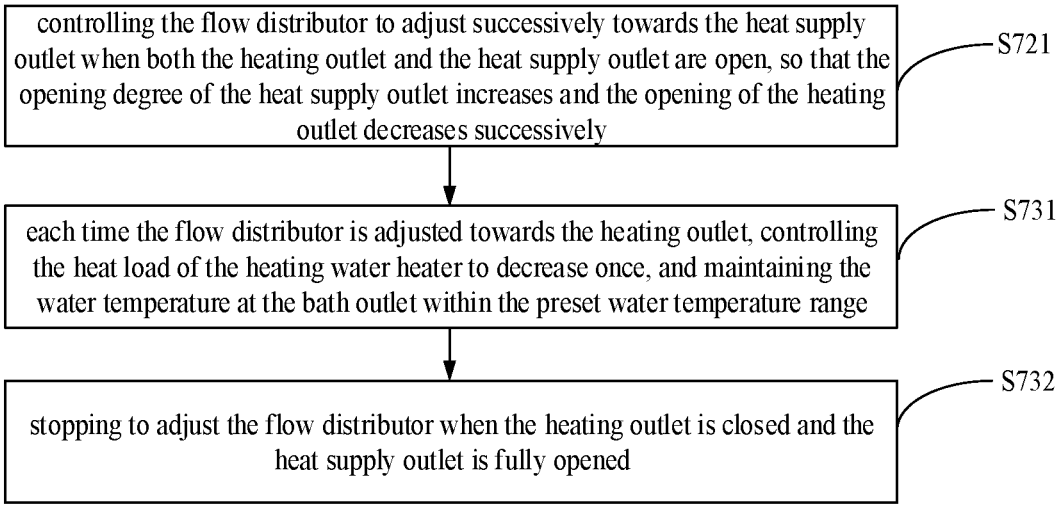
FIG. 6 is a detailed schematic flowchart of operation S72 and operation S73 in FIG. 5.

As shown in FIG. 6, the operation S72 of controlling the heating outlet to be closed, and the heat supply outlet to be fully opened when both the heating outlet and the heat supply outlet are open includes:

Operation S721, controlling the flow distributor to adjust successively towards the heat supply outlet when both the heating outlet and the heat supply outlet are open, and the opening degree of the heat supply outlet increases and the opening of the heating outlet decreases successively;

the operation S73 of adjusting the heat load of the heating water heater and maintaining the water temperature at the bath outlet within the preset water temperature range includes:

Operation S731, each time the flow distributor is adjusted towards the heating outlet, controlling the heat load of the heating water heater to decrease once, and maintaining the water temperature at the bath outlet within the preset water temperature range; and Operation S732, stopping to adjust the flow distributor when the heating outlet is closed and the heat supply outlet is fully opened.

Similarly, in this embodiment, since the flow distributor is adjusted successively towards the heat supply outlet, and the opening degree of the heat supply outlet is small each time, the increase of the hot water flowing into the heat supply branch for heating the bath water is small each time. Therefore, the increase degree in the water temperature at the bath outlet is small, and the water temperature at the bath outlet can still be maintained within the preset water temperature range after the increase, and can be maintained within the preset water temperature range at least within a short period of time after adjusting the flow distributor, to meet the needs of users for using water. Each time the flow distributor is adjusted, the heat load of the heating water heater is adjusted once. The water temperature at the bath outlet is reduced and stabilized within the preset water temperature range, and the water temperature at the bath outlet can be prevented from exceeding the preset water temperature range and the continuous comfort of the user's water consumption can be ensured.

In the operation S731, the power-on duration of the synchronous motor corresponding to the flow distributor is t/n, or the number of pulses sent to the stepping motor corresponding to the flow distributor is N/n. For details, reference may be made to the foregoing embodiments, which will not be repeated herein.

Figure 7:
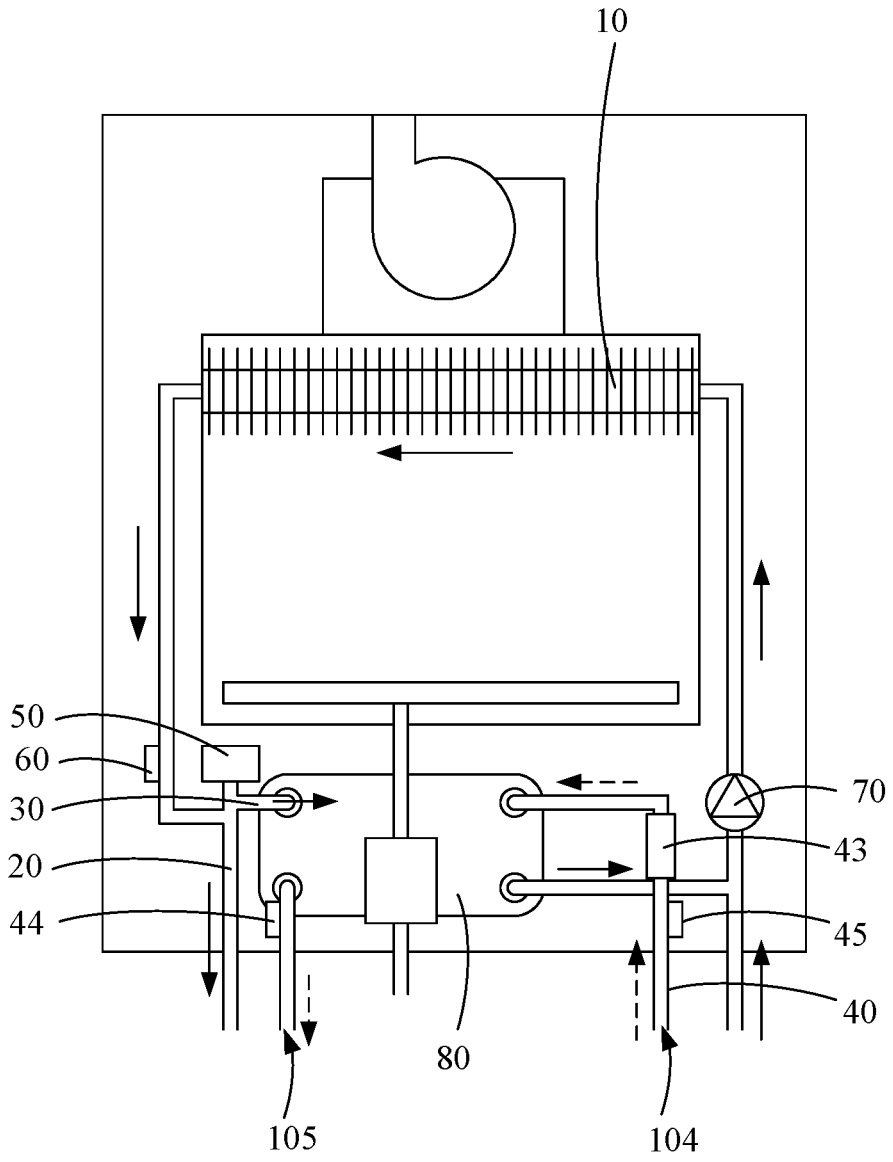
FIG. 7 is a schematic structural view of a heating water heater according to an embodiment of the present disclosure.

As shown in FIG. 7, the present disclosure provides a heating water heater. The heating water heater includes a first heat exchanger 10, a heating branch 20, a heat supply branch 30, a bath flow path 40 and a flow distributor 50, the bath flow path 40 is configured for exchanging heat with the heat supply branch 30, the flow distributor 50 has a heating outlet connected to the heating branch 20, a heat supply outlet connected to the heat supply branch 30, and a water inlet connected to the first heat exchanger 10.

The first heat exchanger 10 can be a fin-and-tube heat exchanger. One end of the heating branch 20 is connected to the heating outlet, and the other end of the heating branch 20 is connected to the heat exchange pipe of the first heat exchanger 10 to form a closed loop. The heating branch 20 is used for indoor heating. One end of the heat supply branch 30 is connected to the heat supply outlet, and the other end of the heat supply branch 30 is connected to the first heat exchanger 10, to form a closed loop. The heat supply branch 30 is used for exchanging heat with the bath flow path 40. In an embodiment, the heat supply branch 30 is provided with a second heat exchanger 80, the second heat exchanger 80 is a plate heat exchanger, and the plate heat exchanger has a first flow channel and a second flow channel independent from the first flow channel. The heat supply branch 30 communicates with the first flow channel, and the bath flow path 40 communicates with the second flow channel. The hot water in the first flow channel and the bath water in the second flow channel exchange heat, to heat the bath water.

In addition, the first heat exchanger 10 and the second heat exchanger 80 can also be in other forms, which will not be repeated herein. The heating source of the first heat exchanger 10 can be a burner, a heat resistance wire, an electric heating rod, a condenser and the like.

One end of the bath flow path 40 is the bath inlet 104, the other end of the bath flow path 40 is the bath outlet 105, the bath inlet 104 is in communication with the water source, the bath outlet 105 is connected to a water terminal such as a shower or a faucet, or the bath outlet 105 can also be connected to a water storage tank. The heating water heater can also include a water storage tank, which can store bath water. When the temperature of the water flowing out of the bath outlet 105 fluctuates, it can be mixed with the water originally stored in the water storage tank, to reduce the fluctuation of the water temperature. The water storage tank is also provided with a water outlet, and the water outlet is connected to the user's water end.

The heating water heater further includes a flow sensor 43, and the flow sensor 43 is provided in the bath flow path 40 for detecting the flow of the bath flow path 40.

The heating water heater further includes a first temperature sensor 44, and the first temperature sensor 44 is provided at the bath outlet 105 for detecting the temperature of the bath outlet 105.

The heating water heater further includes a second temperature sensor 45, and the second temperature sensor 45 is provided at the bath inlet 104 for detecting the temperature of the bath inlet 104.

The heating water heater further includes a third temperature sensor 60, and the third temperature sensor 60 is provided at the outlet of the first heat exchanger 10, for example, can be provided at the water inlet of the flow distributor 50.

In addition, a water pump 70 is provided on the flow path where the first heat exchanger 10 is located to circulate water, and the flow distributor 50 can be a three-way valve. The solid line arrows in FIG. 7 represent the flow direction of hot water in the heating branch 20 and the heat supply branch 30, and the dashed arrows represent the flow direction of bath water in the bath flow path 40.

In some embodiments of the present disclosure, as shown in FIG. 8 to FIG. 13, which are schematic structural views of the heating water heater according to another embodiment of the present disclosure, and the heating water heater includes:

a flow distributor 50 having a hot water inlet 101, a heating diversion port 102, a hot water diversion port 103, a bath inlet 104 and a bath outlet 105, the flow distributor 50 includes a first valve core 11 and a second valve core (not shown), the first valve core 11 is provided between the hot water inlet 101, the heating diversion port 102 and the hot water diversion port 103, and the second valve core is provided between the bath inlet 104 and the bath outlet 105;

a heating system having a heating water outlet 21, a heating water return outlet 22, and a first heat exchanger 10 between the heating water outlet 21 and the heating water return outlet 22, the heating water outlet 21 being connected to the heating diversion port 102, the first heat exchanger 10 being connected to the hot water inlet 101; and a hot water system including a heating flow path and a bath flow path, the heating flow paths being respectively connected to the first heat exchanger 10 and the hot water diversion port 103, the bath flow path being configured for exchanging heat with the heating flow path, the bath flow path including a first inlet 41 connected to the bath inlet 104 and a first outlet 42 connected to the bath outlet 105.

The heating water heater generally further includes a housing 90, and the first heat exchanger 10 and the flow distributor 50 are provided in the housing 90. The flow distributor 50 is fixed to the bottom wall of the housing 90. In an embodiment, the flow distributor 50 and the housing 90 are fixed by screws or by welding or snapping. In this embodiment, the pipeline connected to the heating diversion port 102 of the flow distributor 50 penetrates downward through the bottom wall of the housing 90 and is connected to the heating water outlet 21.

The heating system usually also includes a heating unit for heating the first heat exchanger 10. The heating unit can be different kinds of heating devices. For example, the heating unit can be a burner, which heats the liquid (e.g., water, etc.) flowing through the first heat exchanger 10 by burning the combustible gas. The heating unit can also be an electric heating device, such as a resistance wire, an electric heating rod, etc., to heat the liquid (such as water, etc.) flowing through the first heat exchanger 10 by means of electric heating. The heating unit can also be a condenser, and the liquid (e.g., water, etc.) flowing through the first heat exchanger 10 is heated by the condenser. The types of heating units included are not limited to the above description. Any other heating unit that can heat the liquid (for example, water, etc., which will be described below by taking water as an example) flowing through the first heat exchanger 10 can be used in this embodiment.

The heating system usually also includes a heating device (such as a radiator or a floor heating pipeline) connected between the heating water outlet 21 and the heating return water outlet 22 (not shown). The liquid (such as water, etc.) flowing out of the heating device flows into the first heat exchanger 10 through the heating water return outlet 22, and after being heated by the first heat exchanger 10, the liquid flows into the heating device from the heating water outlet 21. In one embodiment, the heating water return outlet 22 communicates with the inlet of the first heat exchanger 10, and the heating water outlet 21 communicates with the outlet of the first heat exchanger 10.

Bath water (including but not limited to domestic water/bath water, such as laboratory water, etc.) can enter the flow distributor 50 from the first inlet 41 and through the bath inlet 104, flows out of the flow distributor 50 from the bath outlet 105 and flows to the first outlet 42. The bath water exchanges heat with the hot water in the heating flow path in the bath flow path to obtain heated bath water.

The hot water system further includes a second heat exchanger 80, which is a plate heat exchanger. The second heat exchanger 80 has a first flow channel and a second flow channel, the first flow channel constitutes a part of the heating flow path, and the second flow channel constitutes a part of the bath flow path. During operation, the bath water enters the second flow channel through the first inlet 41. The hot water flowing out of the first heat exchanger 10 enters the first flow channel through the hot water diversion port 103, and the hot water in the first flow channel will exchange heat with the bath water in the second flow channel, and to realize the heating of the bath water. After heat exchange, the water in the first flow channel flows back to the first heat exchanger 10, and the heated bath water in the second flow channel flows to the first outlet 42 through the bath inlet 104 and the bath outlet 105 of the flow distributor 50.

Besides, in other embodiments, the second heat exchanger 80 can also be a tubular heat exchanger, and the first flow channel and the second flow channel are coaxial and disposed inside and outside.

The first valve core 11 is provided between the hot water inlet 101, the heating diversion port 102 and the hot water diversion port 103, the first valve core 11 can control the on-off between the hot water inlet 101 and the heating diversion port 102, and the first valve core 11 can also control the on-off between the hot water inlet 101 and the hot water diversion port 103.

In an embodiment, the flow distributor 50 has a heating-only working state for communicating the hot water inlet 101 with the heating diversion port 102. Under the heating-only working state, the first valve core 11 disconnects the hot water inlet 101 and the hot water diversion port 103, and all the hot water flowing out of the first heat exchanger 10 is used for indoor heating. When the flow distributor 50 is in a heating-only working state, the hot water inlet 101 communicates with the heating diversion port 102. The hot water heated by the first heat exchanger 10 flows to the heating water outlet 21 through the flow distributor 50 (the hot water inlet 101 and the heating diversion port 102), and to realize heating by the heating water heater.

In an embodiment, the flow distributor 50 further has a heating and warming mixed working state for communicating both the heating diversion port 102 and the hot water diversion port 103 with the hot water inlet 101. Under the heating and warming mixed working state, the hot water inlet 101 is in communication with the heating diversion port 102, and the hot water inlet 101 is also in communication with the hot water diversion port 103. Under the mixed working state, the first valve core 11 can adjust the opening degree of the heating diversion port 102 and the hot water diversion port 103. For example, when the first valve core 11 moves toward the heating diversion port 102, the opening degree of the heating diversion port 102 decreases, and the opening degree of the hot water diversion port 103 increases accordingly. Similarly, when the first valve core 11 moves toward the hot water diversion port 103, the opening degree of the hot water diversion port 103 decreases, and the opening degree of the heating diversion port 102 increases accordingly. When the flow distributor 50 is in the mixed working state, the hot water inlet 101 communicates with the heating diversion port 102 and the hot water diversion port 103 at the same time. As shown in the figure, a part of the hot water heated by the first heat exchanger 10 flows to the heating water outlet 21 through the flow distributor 50 (the hot water inlet 101 and the heating diversion port 102), and to realize the heating of the heating water heater. At the same time, part of the hot water heated by the first heat exchanger 10 flows to the first flow channel through the flow distributor 50 (the hot water inlet 101 and the hot water diversion port 103), to exchange heat with the bath water in the second flow channel, the bath hot water is heated, and the heating water heater can provide bath hot water.

In an embodiment, the flow distributor 50 further has a heating and warming mixed working state for communicating both the heating diversion port 102 and the hot water diversion port 103 with the hot water inlet 101. Under the heating and warming mixed working state, the hot water inlet 101 is in communication with the heating diversion port 102, and the hot water inlet 101 is also in communication with the hot water diversion port 103. Under the mixed working state, the first valve core 11 can adjust the opening degree of the heating diversion port 102 and the hot water diversion port 103. For example, when the first valve core 11 moves toward the heating diversion port 102, the opening degree of the heating diversion port 102 decreases, and the opening degree of the hot water diversion port 103 increases accordingly. Similarly, when the first valve core 11 moves toward the hot water diversion port 103, the opening degree of the hot water diversion port 103 decreases, and the opening degree of the heating diversion port 102 increases accordingly. When the flow distributor 50 is in the mixed working state, the hot water inlet 101 communicates with the heating diversion port 102 and the hot water diversion port 103 at the same time. As shown in the figure, a part of the hot water heated by the first heat exchanger 10 flows to the heating water outlet 21 through the flow distributor 50 (the hot water inlet 101 and the heating diversion port 102), and to realize the heating of the heating water heater. At the same time, part of the hot water heated by the first heat exchanger 10 flows to the first flow channel through the flow distributor 50 (the hot water inlet 101 and the hot water distribution port 103), to exchange heat with the bath water in the second flow channel, the bath hot water is heated, and the heating water heater can provide bath hot water.

That is to say, when the flow distributor 50 is in a mixed working state, the heating water heater can realize heating and provide bath hot water at the same time (that is, the heating water heater can provide heating and bath water heating at the same time), and to improve the user's comfort.

The heating water heater can realize independent heating, and can also provide bath hot water separately, and can also realize heating and provide bath hot water at the same time (that is, the heating water heater can be used to heat the bath water and realize heating at the same time), and to improve the user's comfort, thus diversifying the functions of the heating water heater.

The second valve core is provided between the bath inlet 104 and the bath outlet 105, and the second valve core can control the on-off between the bath inlet 104 and the bath outlet 105.

In the present disclosure, the flow distributor 50 is an integral structure, and communicating flow channels are processed in its interior, the hot water inlet 101, the heating diversion port 102 and the hot water diversion port 103 are correspondingly connected, and the bath inlet 104 and the bath outlet 105 are correspondingly connected. The heating flow path and the bath flow path in the heating system and the hot water system are all connected together on a flow distributor 50. The flow distributor 50 can not only control the diversion of hot water flowing out from the first heat exchanger 10, but also control the on-off of bath water. The flow distributor 50 integrates the functions of two different valves, three-way and two-way, and does not need to set an independent on-off valve for each flow path. Compared with setting up a three-way valve and a two-way valve separately, or setting up three two-way valves separately, the structure of the flow distributor 50 in this embodiment is more compact, which is beneficial to reduce the occupation of the space of the whole machine.

The hot water system further includes a bath water circulating pump 143 for driving bath water to flow from the first inlet 41 to the first outlet 42 through the second flow channel. In an embodiment, the bath water circulating pump 143 can be provided in the pipeline between the first inlet 41 and the bath inlet 104 or the pipeline between the first outlet 42 and the bath outlet 105.

Further, the first inlet 41 is provided with a first temperature sensor 44; and/or the first outlet 42 is provided with a second temperature sensor 45.

The first temperature sensor 44 is to detect the inlet water temperature/return water temperature of the first inlet 41, and the second temperature sensor 45 is to detect the outlet water temperature of the first outlet 42 to adjust the working state of the flow distributor 50. In this way, the temperature of the bath water can be controlled more accurately, and the problem of the temperature being too high or too low can be prevented.

In some embodiments of the present disclosure, the hot water system further includes a water storage tank 46; of course, in other embodiments, the water storage tank 46 may not be provided. The hot water system and the heating water heater will be described in detail below with reference to the water storage tank 46.

The water storage tank 46 is connected between the first outlet 42 and the second flow channel, and the water storage tank 46 is to store the bath hot water sent out from the second flow channel. The water storage tank 46 is connected between the first outlet 42 and the outlet of the second flow channel.

Figure 8:
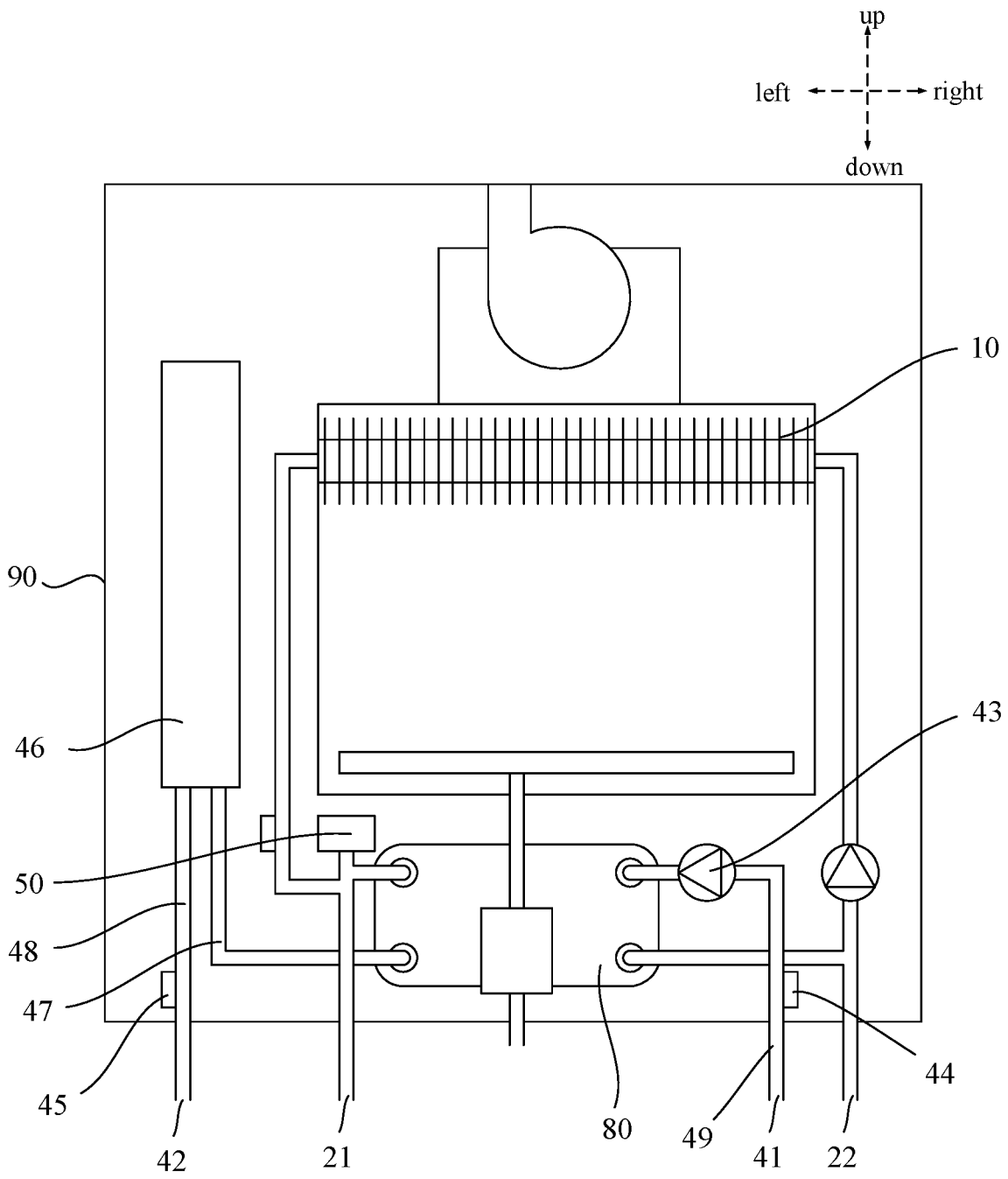
FIG. 8 is a schematic structural view of the heating water heater according to another embodiment of the present disclosure.
Figure 9:
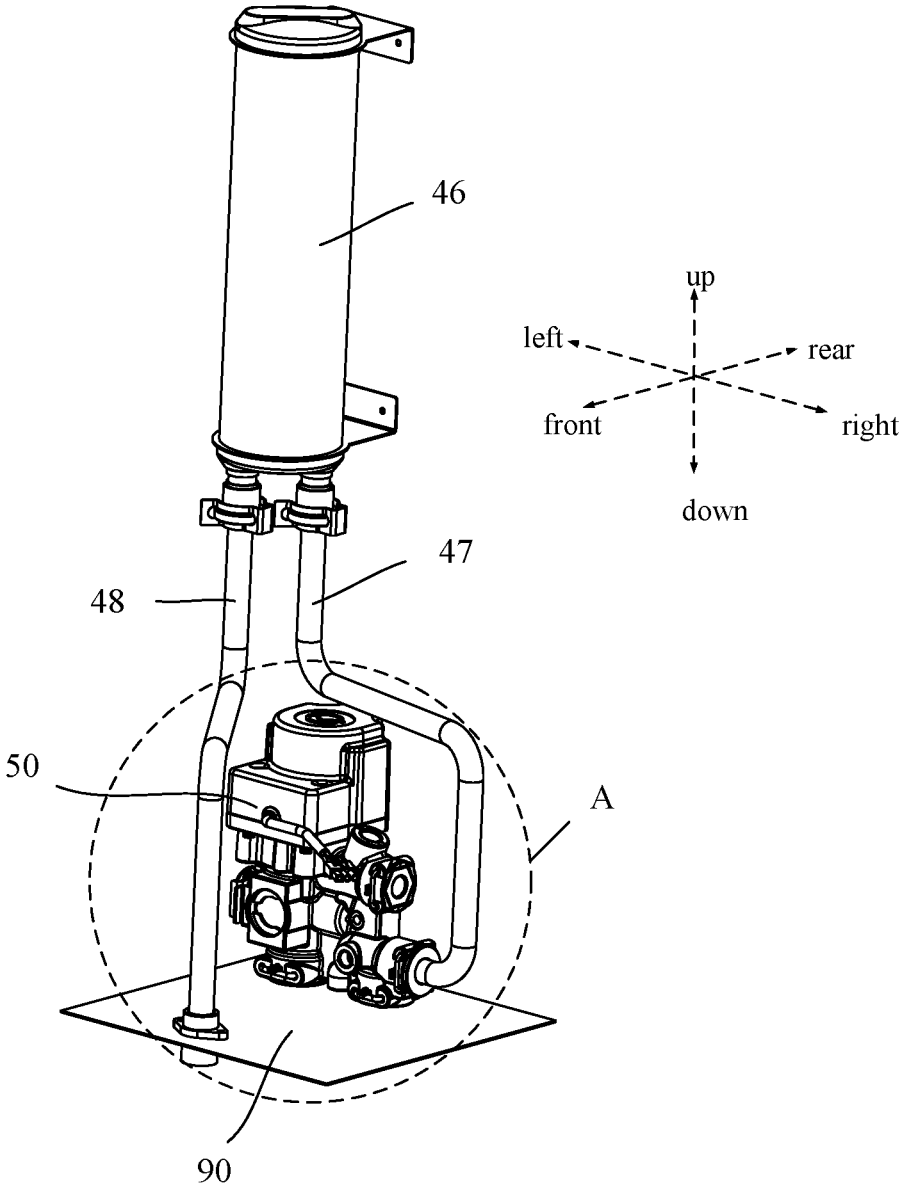
FIG. 9 is a schematic structural view of a flow distributor in FIG. 8.
Figure 10:
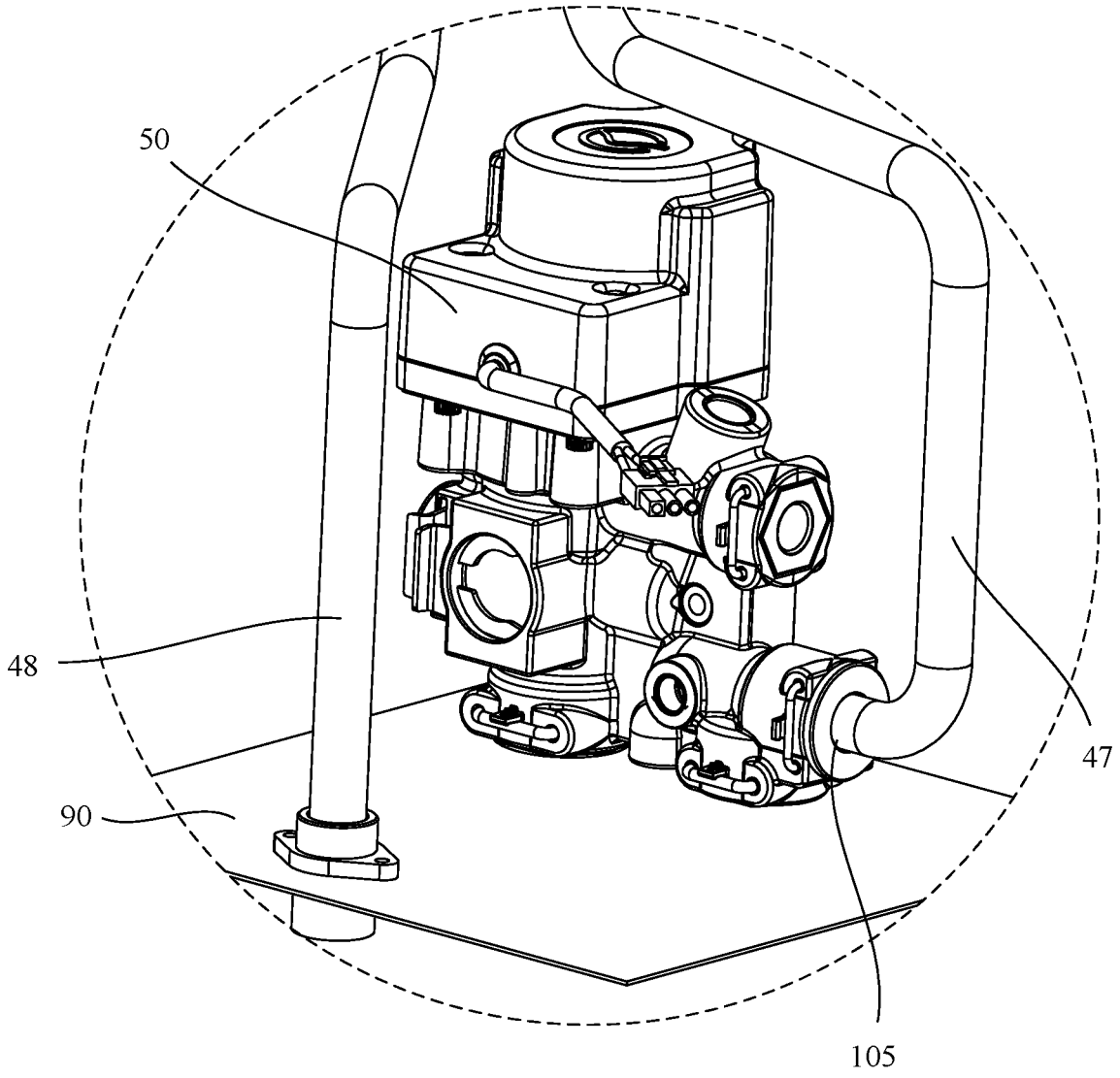
FIG. 10 is an enlarged schematic view of portion A in FIG. 9.

As shown in FIG. 8, the bath flow path includes a first bath water pipeline 47, a second bath water pipeline 48 and a third bath water pipeline 49. The first bath water pipeline 47 is connected to the water inlet of the water storage tank 46 and the bath outlet 105 of the flow distributor 50, and the second bath water pipeline 48 is connected to the water outlet of the water storage tank 46 and the first outlet 42. The third bath water pipeline 49 is respectively connected to the first inlet 41 and the water inlet of the second flow channel, and the second flow channel connects the first bath water pipeline 47 and the third bath water pipeline 49. In this way, the bath water entering from the third bath water pipeline 49 is heated to form bath hot water after the second flow channel is heated. The bath hot water can flow into the water storage tank 46 through the first bath water pipeline 47; and then can flow from the water storage tank 46 to the first outlet 42 through the second bath water pipeline 48.

As such, after entering the water storage tank 46, the bath hot water sent from the second flow channel will be mixed with the bath hot water stored in the water storage tank 46 (it can be understood that the water temperature of the mixed bath hot water is relatively stable), and then the mixed bath hot water flows to the first outlet 42. Therefore, the hot water heated by the second heat exchanger 80 can be prevented from being directly sent to the first outlet 42, to avoid the large fluctuation of the water temperature of the bath hot water flowing out of the first outlet 42, the stability of the water temperature of the bath hot water provided by the heating water heater can be improved.

It can be understood that, in order to reduce the vertical size of the housing 90, the water storage tank 46 is usually provided on one side of the first heat exchanger 10 and the second heat exchanger 80 (the left or right side in the figure).

In an embodiment, the flow distributor 50 is provided at the water outlet end of the second flow channel, so the flow distributor 50 is also provided adjacent to the first flow channel, and the flow distributor 50 is connected to the first flow channel and the second flow channel at the same time. In the embodiment provided with the water storage tank 46, the flow distributor 50 is provided in the first bath water pipeline 47 to prevent the water in the water storage tank 46 from flowing back to the second flow channel.

In an embodiment, the opening direction of the bath outlet 105 is in the lateral direction. The pipeline connected to the bath outlet 105, such as the first bath water pipeline 47 in some embodiments, can extend laterally out. When the water storage tank 46 is located above the flow distributor 50, the first bath water pipeline 47 only needs to be bent upwards once and the bending angle is 90°. Compared with setting the opening direction of the bath outlet 105 downward, the first bath water pipeline 47 needs to be bent horizontally and then upwardly. In this embodiment, the opening of the bath outlet 105 is oriented laterally, which can reduce the number of times and angles of bending of the first bath water pipeline 47 and facilitate the installation of the first bath water pipeline 47.

The first valve core 11, the hot water inlet 101, the heating diversion port 102 and the hot water diversion port 103 are similar to the structure forming a three-way valve. The second valve core, the bath inlet 104 and the bath outlet 105 are similar to the structure forming a two-way valve. In the present disclosure, the three-way valve and the two-way valve are combined to form an integral structure, which not only makes the structure between the two compact, but also eliminates the need for additional assembly between the two, reducing the installation steps.

In an embodiment, the bath inlet 104 and the bath outlet 105 are jointly arranged on the same side of the hot water inlet 101, the heating diversion port 102 and the hot water diversion port 103. For example, the bath inlet 104 and the bath outlet 105 are jointly arranged on the left or right side of the hot water inlet 101, the heating diversion port 102 and the hot water diversion port 103. That is, the three-way valve and the two-way valve are arranged in the left and right directions, and the parts that make up the same valve are concentrated on one side, and the structure is more compact.

The hot water inlet 101, the heating diversion port 102, the hot water diversion port 103 and the bath outlet 105 are respectively provided on different surfaces of the flow distributor 50. The hot water diversion port 103 and the bath inlet 104 are provided on the same side of the flow distributor 50. In an embodiment, the hot water inlet 101 is provided on the left side of the flow distributor, and the heating diversion port 102 is provided at the bottom of the flow distributor. The hot water diversion port 103 and the bath inlet 104 are provided on the rear side of the flow distributor, and the bath outlet 105 is provided on the right side of the flow distributor. As such, the hot water diversion port 103 and the bath inlet 104 are arranged on the same side of the flow distributor 50. Since both are connected to the second heat exchanger 80, the structures of the two on the same side are more compact, which can reduce the bending of the pipeline. The hot water inlet 101, the heating diversion port 102, the hot water diversion port 103 and the bath outlet 105 are respectively provided on different surfaces of the flow distributor 50, and pipelines connecting different locations extend in different directions to avoid staggering between pipelines.

The flow distributor 50 also has a spare water outlet 106 in communication with the bath inlet 104 and the bath outlet 105. The bath water flowing into the flow distributor 50 from the second flow channel can flow to both the bath outlet 105 and the spare water outlet 106. The flow distributor 50 further includes a blocking member 12 for blocking the spare water outlet 106. As such, the bath water flowing into the flow distributor 50 from the second flow channel can only flow to the bath outlet 105, but when the spare water outlet 106 needs to be used, only the blocking member 12 needs to be removed, to improve the flexibility of use.

Figure 11:
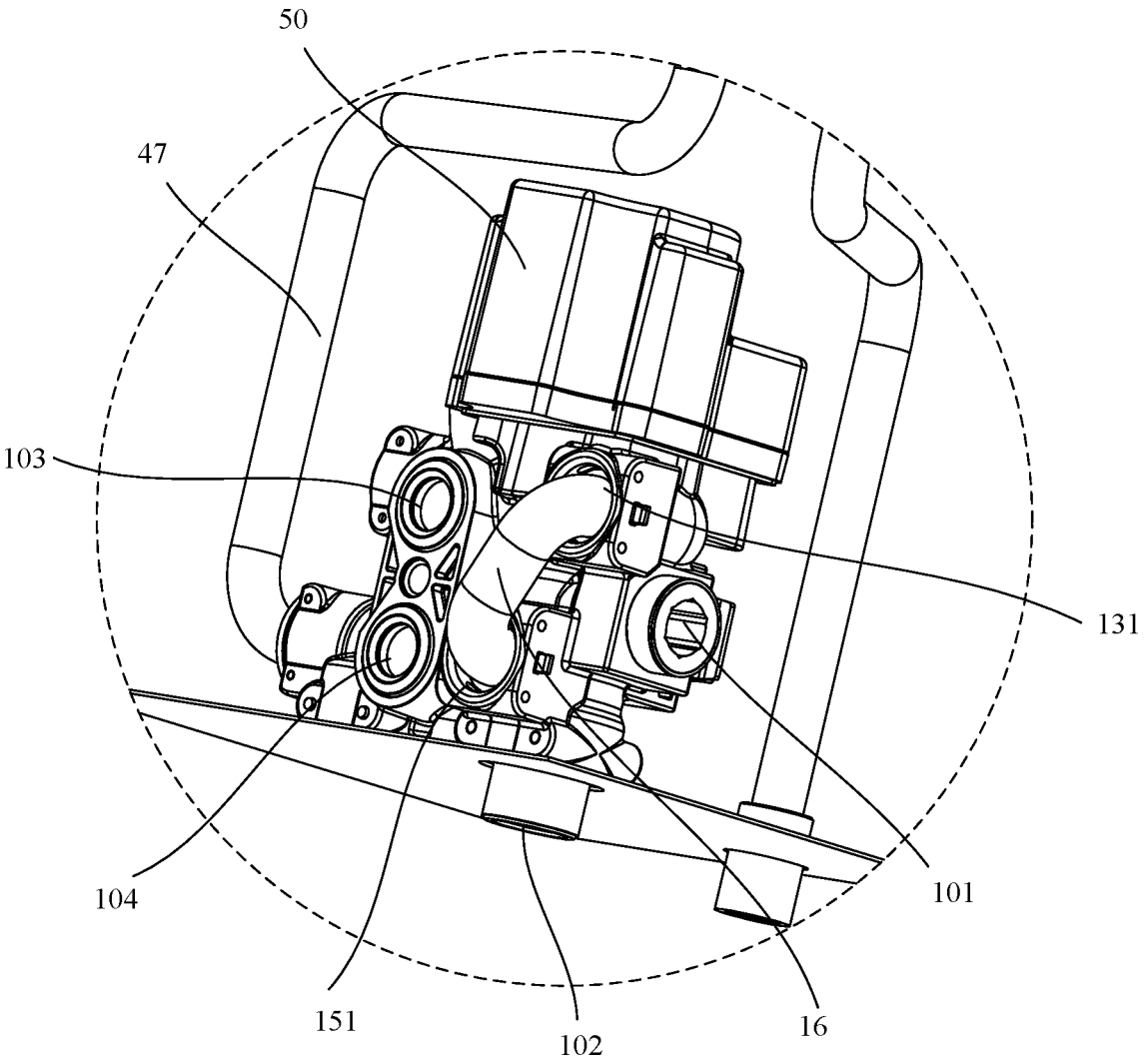
FIG. 11 is a partial schematic view of the flow distributor in FIG. 9 from another perspective.
Figure 12:
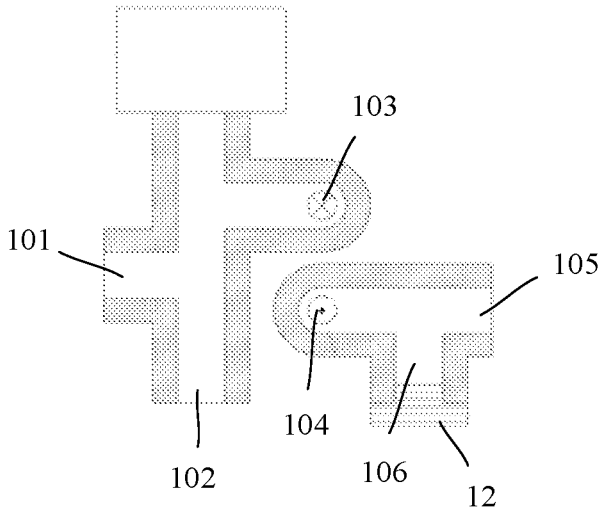
FIG. 12 is a simplified structural schematic view of the flow distributor in FIG. 9.
Figure 13:
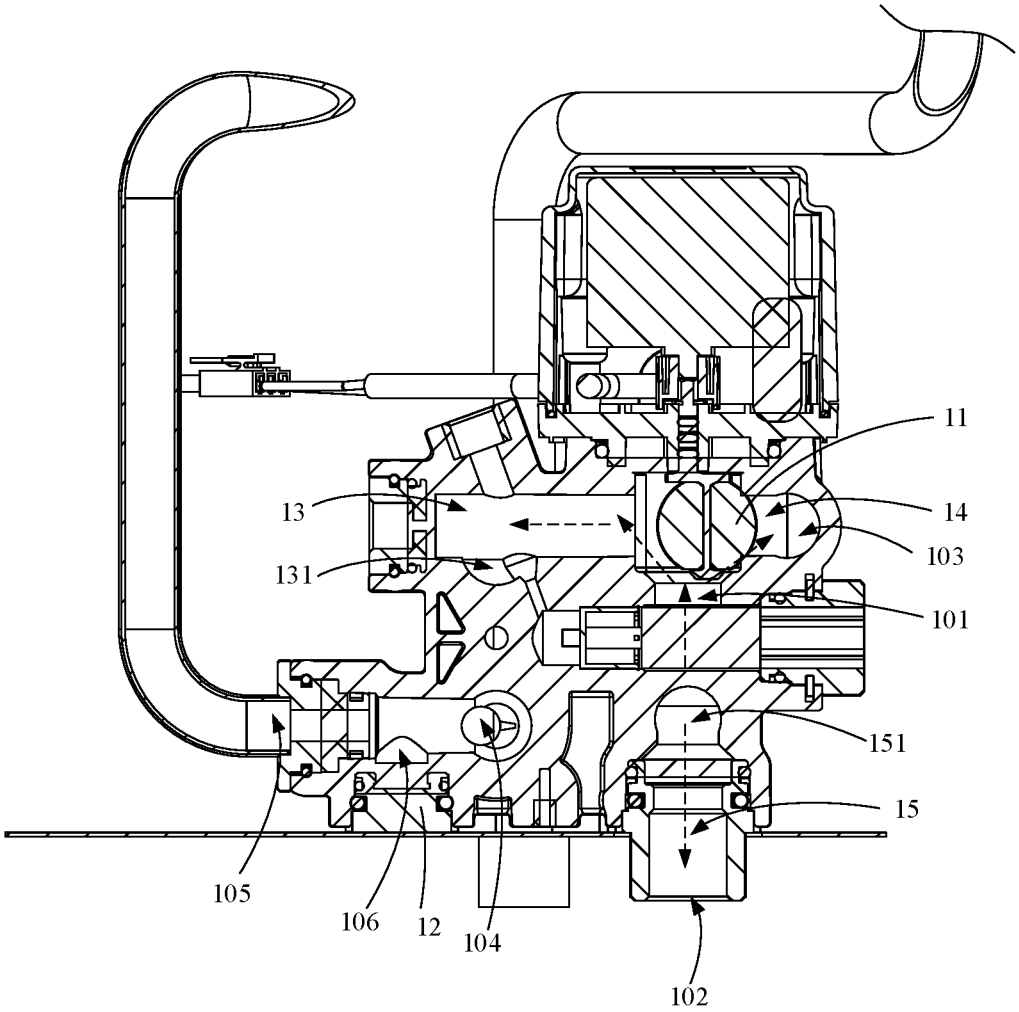
FIG. 13 is a schematic cross-sectional view of the flow distributor of FIG. 9.

As shown in FIG. 13, the flow distributor 50 is provided with a heating diversion flow channel 13, a warming diversion flow channel 14 and a heating outlet flow channel 15, the heating diversion flow channel 13 and the warming diversion flow channel 14 are respectively connected to the hot water inlet 101, and the hot water diversion port 103 is provided on a pipe wall of the warming diversion flow channel 14. A pipe wall of the heating diversion flow channel 13 is provided with a first opening 131 passing through the flow distributor 50, the heating outlet flow channel 15 passes through one of the surfaces of the flow distributor 50 to form the heating diversion port 102, a pipe wall of the heating outlet flow channel 15 is provided with a second opening 151 passing through the flow distributor 50, the first opening 131 and the second opening 151 are connected by a bypass pipeline 16 (as shown in FIG. 11). The hot water flowing out from the first heat exchanger 10 flows into the hot water inlet 101 of the flow distributor 50. Under the mixed condition, the hot water is divided into two paths, one path flows to the heating diversion flow channel 13, the other path flows to the warming diversion flow channel 14. The hot water in the heating diversion flow channel 13 flows from the first opening 131 to the bypass pipeline 16, and flows from the second opening 151 to the heating outlet flow channel 15, then flows from the heating diversion port 102 to the heating water outlet 21, and finally returns to the first heat exchanger 10 from the heating water return outlet 22. The hot water in the warming diversion flow channel 14 flows from the hot water diversion port 103 to the first flow channel of the second heat exchanger 80, and returns to the first heat exchanger 10 after exchanging heat with bath water. The dashed arrows in FIG. 13 represent the direction of water flow.

By arranging the bypass pipeline 16, the first opening 131 and the second opening 151 can be communicated, which facilitates the processing of each flow channel.

The heating water heater also includes a memory, a processor and a computer program stored on the memory and executable on the processor. When the computer program is executed by the processor, the operations of the method as described above are implemented.

The present disclosure also provides a computer-readable storage medium. The computer-readable storage medium stores a processing program for a heating water heater is stored in the computer-readable storage medium, when the processing program for the heating water heater is executed by a controller, the operations of the method for controlling the heating water heater as described above are implemented.

What is claimed is:

1. A method for controlling a heating water heater, wherein the heating water heater comprises:

a flow distributor, a heating branch, a heat supply branch and a bath flow path, the flow distributor has a heating outlet connected to the heating branch and a heat supply outlet connected to the heat supply branch, and the bath flow path is configured for heat exchange with the heat supply branch;

the method for controlling the heating water heater comprises:

controlling the heating outlet to be closed and the heat supply outlet to be opened after receiving a bath water signal;

obtaining a water temperature of a bath outlet;

obtaining a duration that the water temperature at the bath outlet is within a preset water temperature range;

controlling an opening degree of the heat supply outlet to decrease and an opening degree of the heating outlet to increase when the duration is greater than or equal to a first preset duration, and a heat load of the heating water heater is less than a rated load; and controlling the heat load of the heating water heater to increase, and maintaining the water temperature at the bath outlet within the preset water temperature range.

2. The method for controlling the heating water heater of claim 1, wherein the controlling of the opening degree of the heat supply outlet to decrease and an opening degree of the heating outlet to increase when the duration is greater than or equal to a first preset duration, and a heat load of the heating water heater is less than a rated load comprises:

controlling the flow distributor to adjust successively towards the heating outlet, such that the opening degree of the heat supply outlet decreases successively and the opening degree of the heating outlet increases successively when the duration is greater than or equal to the first preset duration, and the heat load of the heating water heater is less than the rated load;

the controlling of the heat load of the heating water heater to increase, and maintaining the water temperature at the bath outlet within the preset water temperature range comprises:

each time the flow distributor is adjusted towards the heating outlet, controlling the heat load of the heating water heater to increase once, and maintaining the water temperature at the bath outlet within the preset water temperature range; and stopping to adjust the flow distributor when the heat load of the heating water heater reaches the rated load.

3. The method for controlling the heating water heater of claim 2, wherein the heating water heater further comprises a motor connected to the flow distributor;

the motor is a synchronous motor, and each time the flow distributor is adjusted towards the heating outlet, a corresponding power-on duration of the synchronous motor is t/n; t is a power-on duration required for the synchronous motor to drive the flow distributor to completely switch between the heating outlet and the heat supply outlet, and n is a constant; or the motor is a stepping motor, and each time the flow distributor is adjusted towards the heating outlet, a corresponding number of pulses sent to the stepping motor is N/n; N is a number of pulses required for the stepping motor to drive the flow distributor to completely switch between the heating outlet and the heat supply outlet, and n is a constant.

4. The method for controlling the heating water heater of claim 3, wherein n is greater than or equal to 10 and less than or equal to 20.

5. The method for controlling the heating water heater of claim 2, wherein after the stopping to adjust the flow distributor when the heat load of the heating water heater reaches the rated load, the method further comprises:

controlling the heat supply outlet to increase a preset opening degree, and the heating outlet to decrease the preset opening degree when the water temperature at the bath outlet is lower than the preset water temperature range, and adjusting the heat load of the heating water heater and maintaining the water temperature at the bath outlet within the preset water temperature range.

6. The method for controlling the heating water heater of claim 5, wherein the controlling of the heat supply outlet to increase a preset opening degree, and the heating outlet to decrease the preset opening degree when the water temperature at the bath outlet is lower than the preset water temperature range comprises:

obtaining adjustment times A of the flow distributor towards the heating outlet;

obtaining flow $q_1$ of the bath flow path when the water temperature of the bath outlet is within the preset water temperature range;

obtaining flow $q_2$ of the bath flow path when the water temperature at the bath outlet is lower than the preset water temperature range;

calculating the preset opening degree according to A, $q_1$ and $q_2$; and controlling the heat supply outlet to increase the preset opening degree, and the heating outlet to decrease the preset opening degree.

7. The method for controlling the heating water heater of claim 6, wherein the heating water heater further comprises a motor connected to the flow distributor;

the motor is a synchronous motor, and a power-on duration of the synchronous motor corresponding to the preset opening degree is Bt/n; or the motor is a stepping motor, and a number of pulses sent to the stepping motor corresponding to the preset opening degree is BN/n; and B is calculated from A, $q_1$, and $q_2$, and n is a constant.

8. The method for controlling the heating water heater of claim 7, wherein a relationship between B and A, $q_1$ and $q_2$ is:

$$B=(q_2-q_1)(n-A)/q_1.$$

9. The method for controlling the heating water heater of claim 1, further comprising the following operations:

obtaining an instruction to stop heating;

controlling the heating outlet to be closed, and the heat supply outlet to be fully opened when both the heating outlet and the heat supply outlet are open; and adjusting the heat load of the heating water heater and maintaining the water temperature at the bath outlet within the preset water temperature range.

10. The method for controlling the heating water heater of claim 9, wherein the controlling of the heating outlet to be closed, and the heat supply outlet to be fully opened when both the heating outlet and the heat supply outlet are open comprises:

controlling the flow distributor to adjust successively towards the heat supply outlet when both the heating outlet and the heat supply outlet are open, so that the opening degree of the heat supply outlet increases and the opening of the heating outlet decreases successively;

the adjusting of the heat load of the heating water heater and maintaining the water temperature at the bath outlet within the preset water temperature range comprises:

each time the flow distributor is adjusted towards the heating outlet, controlling the heat load of the heating water heater to decrease once, and maintaining the water temperature at the bath outlet within the preset water temperature range; and stopping to adjust the flow distributor when the heating outlet is closed and the heat supply outlet is fully opened.

11. A heating water heater, wherein the heating water heater comprises a first heat exchanger, a heating branch, a heat supply branch, a bath flow path and a flow distributor, the bath flow path is configured for exchanging heat with the heat supply branch, the flow distributor has a heating outlet connected to the heating branch, a heat supply outlet connected to the heat supply branch, and a water inlet connected to the first heat exchanger;

the heating water heater further comprises a memory, a processor, and a computer program stored in the memory and executable on the processor, when the computer program is executed by the processor, the operations of the method according to claim 1 are implemented.

12. The heating water heater of claim 11, wherein the flow distributor also has a hot water inlet, a heating diversion port, a hot water diversion port, a bath inlet and a bath outlet, the flow distributor comprises a first valve core and a second valve core, the first valve core is provided between the hot water inlet, the heating diversion port and the hot water diversion port, and the second valve core is provided between the bath inlet and the bath outlet.

13. The heating water heater of claim 12, further comprising:

a heating system comprising a heating water outlet, a heating water return outlet, and a first heat exchanger between the heating water outlet and the heating water return outlet, the heating water outlet being connected to the heating diversion port, the first heat exchanger being connected to the hot water inlet; and a hot water system comprising a heating flow path and a bath flow path, the heating flow paths being respectively connected to the first heat exchanger and the hot water diversion port, the bath flow path being configured for exchanging heat with the heating flow path, the bath flow path comprising a first inlet connected to the bath inlet and a first outlet connected to the bath outlet.

14. The heating water heater of claim 13, wherein an opening direction of the bath outlet is lateral, and the bath inlet and the bath outlet are jointly provided on a same side of the hot water inlet, the heating diversion port and the hot water diversion port.

15. The heating water heater of claim 13, wherein the hot water inlet, the heating diversion port, the hot water diversion port and the bath outlet are respectively provided on different surfaces of the flow distributor, and the hot water diversion port and the bath inlet are provided on a same side of the flow distributor.

16. The heating water heater of claim 13, wherein the flow distributor also has a spare water outlet in communication with the bath inlet and the bath outlet, and the flow distributor further comprises a blocking member for blocking the spare water outlet.

17. The heating water heater of claim 13, wherein:

the flow distributor has a heating-only working state, a warming-only working state and a heating and warming mixed working state;

the first valve core is configured to communicate the hot water inlet with the heating diversion port under the heating-only working state;

the first valve core is configured to communicate the hot water inlet with the hot water diversion port under the warming-only working state; and the first valve core is configured to communicate both the heating diversion port and the hot water diversion port with the hot water inlet under the heating and warming mixed working state.

18. The heating water heater of claim 13, wherein:

the flow distributor is provided with a heating diversion flow channel, a warming diversion flow channel and a heating outlet flow channel, the heating diversion flow channel and the warming diversion flow channel are respectively connected to the hot water inlet, and the hot water diversion port is provided on a pipe wall of the warming diversion flow channel;

a pipe wall of the heating diversion flow channel is provided with a first opening passing through the flow distributor, the heating outlet flow channel is extended to pass through one of the surfaces of the flow distributor to form the heating diversion port, a pipe wall of the heating outlet flow channel is provided with a second opening passing through the flow distributor, the first opening and the second opening are connected by a bypass pipeline.

19. The heating water heater of claim 13, further comprising:

a housing;

wherein the first heat exchanger and the flow distributor are provided in the housing, and the flow distributor is fixed to a bottom wall of the housing.

20. A computer-readable storage medium, wherein a processing program for a heating water heater is stored in the computer-readable storage medium, when the processing program for the heating water heater is executed by a controller, the operations of the method for controlling the heating water heater according to claim 1 are implemented.

* * * * *